United States Patent [19]

Steiner

[11] Patent Number: 4,607,747

[45] Date of Patent: Aug. 26, 1986

[54] PACKAGING FOR A PRODUCT AS WELL AS USE OF THE SAME

[76] Inventor: Andi Steiner, Johannesgasse 3, 8005 Zurich, Switzerland

[21] Appl. No.: 698,372

[22] Filed: Feb. 4, 1985

[30] Foreign Application Priority Data

Sep. 12, 1984 [CH] Switzerland ..... 4363/84

[51] Int. Cl.[4] ..... B65D 81/00

[52] U.S. Cl. ..... 206/232; 40/442; 40/455; 40/902; 84/94 C; 116/1; 116/100; 206/459; 229/116; 362/98

[58] Field of Search ..... 40/427, 442, 455, 457, 40/459, 464, 466–469, 124.1, 902, 906; 84/2, 3, 94 C, 94 R; 116/1, 2, 100, 234, 238, 239, 303, 278; 206/232, 233, 312, 313, 459, 315.1, 597, 822; 229/22, 17 R, 92.8; 446/175, 270, 297, 409; 362/98, 800, 802, 808

[56] References Cited

U.S. PATENT DOCUMENTS

| | | | |
|---|---|---|---|
| 490,680 | 1/1893 | Roberts | 229/22 |
| 700,049 | 5/1902 | Hover | 229/22 |
| 911,884 | 2/1909 | Kyle | 206/831 |
| 1,269,918 | 6/1918 | Fietsch, Jr. | 229/37 R |
| 1,597,757 | 8/1926 | Berger | 229/17 R |
| 4,102,067 | 7/1978 | Tarrant | 40/455 |
| 4,222,188 | 9/1980 | Tarrant et al. | 40/455 |
| 4,363,081 | 12/1982 | Wilbur | 40/442 |
| 4,434,567 | 3/1984 | Leveau | 84/94 C |

FOREIGN PATENT DOCUMENTS

| | | | |
|---|---|---|---|
| 0002772 | of 1892 | United Kingdom | 229/22 |

*Primary Examiner*—William Price
*Assistant Examiner*—Jimmy G. Foster
*Attorney, Agent, or Firm*—James E. Nilles

[57] ABSTRACT

A carton for gift merchandise is formed from a single blank that is cut and folded to be set up into a carton having a double-thickness wall between layers of which a battery powered signal generator is concealed and protected. Another wall of the carton, having an integral hinged connection to one of the layers of the double-thickness wall, is arranged to be a closure for the carton which has to be unfolded or swung open for opening of the carton and which has an actuator connection with the generator that starts it when the carton is opened. Blanks for both cube-shaped and pyramidal cartons are disclosed.

26 Claims, 7 Drawing Figures

PACKAGING FOR A PRODUCT AS WELL AS USE OF THE SAME

The present invention concerns packaging for a product in a container, a package which is cube-shaped with a bottom, four sides and a top, or a pyramid-shaped package with a rectangular base, as well as the use of these packages.

It is known to provide cards, e.g. greeting cards with a melody generator that is activated upon opening such a folded card.

It is an object of the present invention to provide a package of the type mentioned above which when opened, as in the case of a gift package, sounds a melody or produces a series of optical signals, for example the illumination of Christmas candles on a Christmas tree imprinted on the package or the playing of a Christmas melody. This significantly raises the surprise of a person to whom such a package is given and thus favours selling of goods which are packed that way, keeping in mind that the provision of additions to the package to sound a melody are relatively inexpensive with respect to costs of the good, contrary to cards where such additions are expensive relative to the price of the card itself. This is achieved through the provision of a batter-powered signal generator on the container, emitting acoustic and/or optical signals and an activation switch for the generator attached to an opening part of the container in such a manner that the generator is activated by opening of the container. In order, on the one hand, to permit the container to be written upon and imprinted in the usual manner, and on the other hand to ensure a certain surprise effect, and at the same time to keep the container stackable, it is proposed in one embodiment that the generator be located on the inside of the container.

Generators of this type are familiar in themselves. In FIG. 1 there is illustrated such a generator, which comprises a loudspeaker 1 and an electronic chip 3, all brought together upon a cardboard carrier that as a self-adhesive underside, and provided with an activating switch 7 in the form of a pull-release. The switch 7 is tripped by bending a cardboard strap 9, on which a pull-element 11 is located, around the axis A. In order to keep the generator from being damaged by the product, whether by mechanical stress due to installation or removal of the product, or by electrical conductivity of, for example, a product packed in aluminium foil, or by moisture generation, etc., it is proposed in a further modification that the container be constructed with a double wall in at least one area within which the signal generator is located. With this, in order to provide additionally to a self-adhesive fixation, upon installation of a generator such as is illustrated in FIG. 1, an additional mounting fixation for the generator, as well as to have the provision of the generator occupy the least possible volume, it is further proposed that the walls of the double wall construction be formed so they are biased towards one another, at least in the area of the signal generator.

An extremely simple construction of this type of resilient generator mounting or covering is achieved in one embodiment by providing a covering on the wall on which the generator is arranged, having at least one slit of such character that a portion of the covering in the area of the incision lies elastically over the generator within the limits of the elasticity of the covering material.

Should a generator be installed that is, for example, like the one illustrated in FIG. 1, having a mainly cube-shaped volume, then in a modified embodiment it is proposed to provide in the cover two incisions that are at least nearly parallel and are preferably restricted on both sides in order to form an elastic band over the generator.

Considering the requirements for mass production of this type of packaging, in which assembly of such a package from several components is not optimal, it is further proposed in a modified embodiment that the double wall or the single wall and covering, as the case may be, are formed in one piece and are capable of being superimposed upon one another by folding or bending. In this connection an additional optimal condition is achieved if the container comprises a one-piece blank and can be set up by folding or bending, and preferably with tab and slot connections. This enables the entire container, blanked out in one piece, to be manufactured with fold lines and slits, then imprinted, and finally assembled into a three-dimensional container without any provision for glue-joints. A preferred embodiment of the packaging container—for example, for the packaging of chocolate bar—is realized in an embodiment according to which the container has a rectangular exterior bottom portion to a first side of which a rectangular cover portion is connected by means of a front wall portion and on a second side of the exterior base portion, bordering the first side, a rectangular cover portion is attached by means of a wide side portion, wherein a rectangular inner bottom does form a double-bottom, is connected to the cover portion, opposite the wide side portion, by means of a second wide side portion, wherein, further, a locking rear portion is connected to the exterior bottom portion or to the cover portion opposite the first side of the outer bottom portion and wherein attachment connections are provided for setting up the container.

In a further embodiment, the generator, constructed as illustrated for example in FIG. 1, is arranged on a bottom portion, preferably glued on, and a pull-release for the activation switch is fastened onto a wall that is to be opened, wherein the overlay portion is provided with two at least nearly parallel slits that form a biased band overlying the generator.

For the simplest, most cost-effective fabrication possible, it is suggested that the blank for the container be blanked out of cardboard or paper, preferably in one piece.

Obviously it is desirable to remove certain sales information such as sales prices, especially for gift packages. This is advantageously achieved in the package according to the invention through the provision of a tearable tab which is in one piece with the container, which forms a tab to carry the price imprint that can be torn off for gift use, of such type that after sale of such a package this removable tab—which can be connected with the wrapping of the container by a tear-off perforation—can be torn off by the salesperson in a simple manner. Depending upon the goods to be packaged, it is proposed in a further modification to form the container in a pyramid or tetrahedron-shape.

Without considering provision of a generator, a package pe se that is extraordinarily simple to manufacture, with a bottom surface, four side surfaces and a top surface is inventively so formed, for setting up a unitary wrapping and for assuring a package assembly free from glue-points, that a first top surface is connected to a first side of the bottom surface via a first side surface; a second top surface is connected to a second side of the bottom surface, adjacent to the first side, by means of a second side surface; and a third side surface is connected to the second top surface, opposite the second side surface; and, further, that a fourth side surface is connected to the third side of the bottom surface, adjacent to the second side, or to the first top surface, opposite the first side surface; and that tab/slot-means are provided for assembling the container into a cube. Should such a package or container provide for incorporating, for example, the aforementioned generator, it is proposed in a modified embodiment of this packaging that a second bottom surface be connected to the third side surface to form a double-walled bottom.

In this, an elastic portion is advantageously provided in the double bottom, preferably integrated with it, for an elastic mounting for an element such as a sound or light generator lying between the bottom surface or walls.

A pyramid-shaped package with a rectangular bottom surface has in its blank a rectangular base, preferably square, once again for the formation of a unitary set-up and assurance of assembly without glue, and to each of three of the rectangle sides triangular pyramid side-surfaces are connected; further, to one of the triangular side surfaces, adjacent to the fourth side of the rectangle, there is connected a further triangular side surface whereby tab/slot-means are provided for assembly of the pyramid. Here too, in a construction variation of the pyramid-shaped package, a second square surface is connected to the fourth square side in order to form a double bottom for the pyramid for the insertion of, for example, a generator as previously described. In addition elastic means are provided here too, on at least one square surface and preferably integral thereto for the elastic mounting of an element such as the aforementioned generator between the square surfaces. All of the described packages or containers are preferably manufactured from cardboard or hard paper. A sound-series melody generator and/or a generator that controls a light display on the package is provided as the signal generator, such as a generator that controls an LED arrangement, wherein the control of such LED diodes is likewise known. The aforementioned packages are particularly suitable for gift packages for chocolates. Depending on the geometric shape, they can, however, also be used for further packaging purposes such as for jewelry packaging, toy packaging and packaging of pralines, etc.

The invention is hereinafter explained by way of examples with reference to the drawings, in which.

Figure 2:
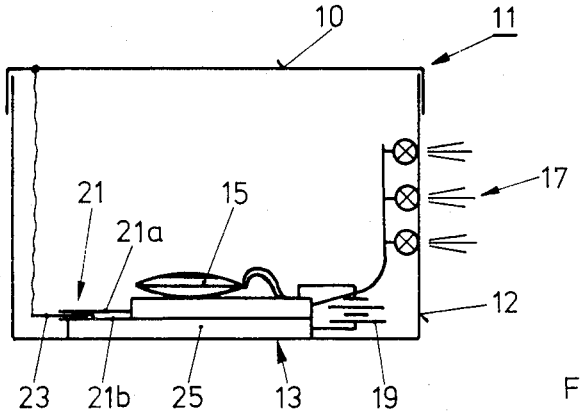
FIG. 2 is a schematic illustration of a package according to the invention.

In FIG. 2 is illustrated purely schematically the principle of a first embodiment of a package according to the invention. It comprises a container 11, formed from a cover 10 and a bottom piece 12, wherein a signal generator 13 is arranged, either as illustrated on the inside of the container or otherwise on its outside, and as an acoustic generator, provided with a loudspeaker 15 for the emission of a series of sounds—a melody—and/or connected with one or more light diodes 17 for producing supplemental or independent optical signals. The generator 15 is battery-powered, as illustrated schematically at 19, and has a starting switch 21 formed as a pull switch wherein, for example, two electrical contact portions 21*a* and 21*b* resiliently overlay one another with an insulating pull-actuated element 23 arranged between them. The pull-operated device 23 is so connected to the cover 10 that when the container 11 is opened the element 23 between the contact portions 21*a*, 21*b* is pulled out so that the contacts now close an electrical circuit for the operation of the generator 13.

Figure 1:
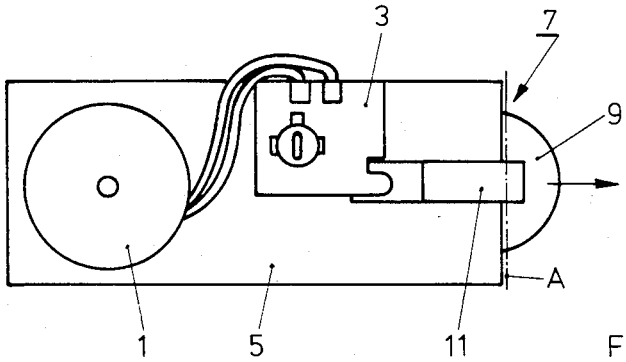
FIG. 1 PRIOR ART
FIG. 1 is a known signal generator (see introduction)
Figure 3:
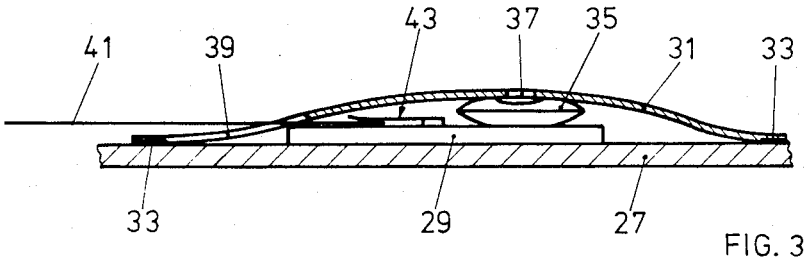
FIG. 3 is a detail of a package according to the invention, with the generator uncovered.

The generator illustrated in FIG. 2 can be of a type already known in the art and illustrated in FIG. 1. In order not to enlarge the volume of this type of package with the additionally provided generator and in order to maintain its stackability, for example, with planar bases, at least the electronic components, battery, loudspeaker, etc. of the generator are arranged towards the inside of the containter 11. To fulfill this target it is obvious that a generator carrier 25 can be arranged in the inside of the container, but also on the outside, and then the aforementioned components of the generator can be inserted through suitable openings in the container wall into its interior. In both cases, however, a covering for the generator 13 must be provided particularly with the use of such packaging for goods which by their packaging or their removal could mechanically damage the generator or which by their storage could influence the function of the generator by humidity or the like. Such a covering is illustrated in principle in FIG. 3. To a container wall 27 is cemented the modular generator 29, constructed, for example, as illustrated in FIG. 1. On the inside of the container a covering 31 is fastened on at least one side to the wall 27 as, for example, by being cemented to the wall 27 at the points 33, and is stretched elastically over the generator. To ensure the best possible sound quality with the illustrated form of the generator 29 as a melodic generator, a sound aperture 37 is provided coaxially with the loudspeaker 35 in the covering 31. Preferably, the container—like the covering 31—is constructed from hard paper or cardboard, and it has a slot opening 39 through which an actuating element 41 for the release switch acts on the generator 29.

Figure 4:
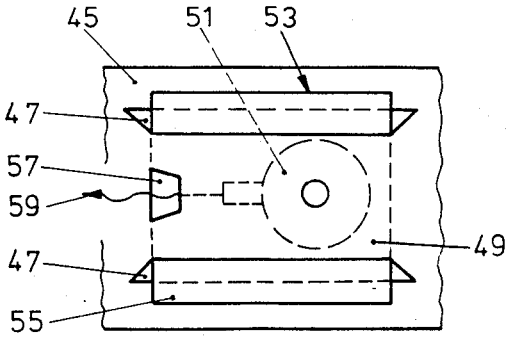
FIG. 4 is a plan view of a further modified embodiment of a package according to the invention, with the generator uncovered.

In FIG. 4 there is illustrated a highly simplified form of generator covering. Slots 47 are cut in a wall 45 of the container, which is made of cardboard or hard paper. By these a band-shaped covering 49 is formed, defined on the left and the right by the said slots. A generator 51 on a mounting plate 53, likewise constructed, for example, of cardboard and possibly self-adhesive, is so inserted through the two slots 47 that the two margins 55 of the mounting plate rest, on both sides, on the wall 45 and the covering 49 is tensioned over the generator 51. There is again provided an outlet slot 57 for an actuating element 59 for the generator release switch. This construction has, on the one hand, the advantage of great simplicity, but the disadvantage that the generator is perceptible from the exterior of the container.

Figure 5:
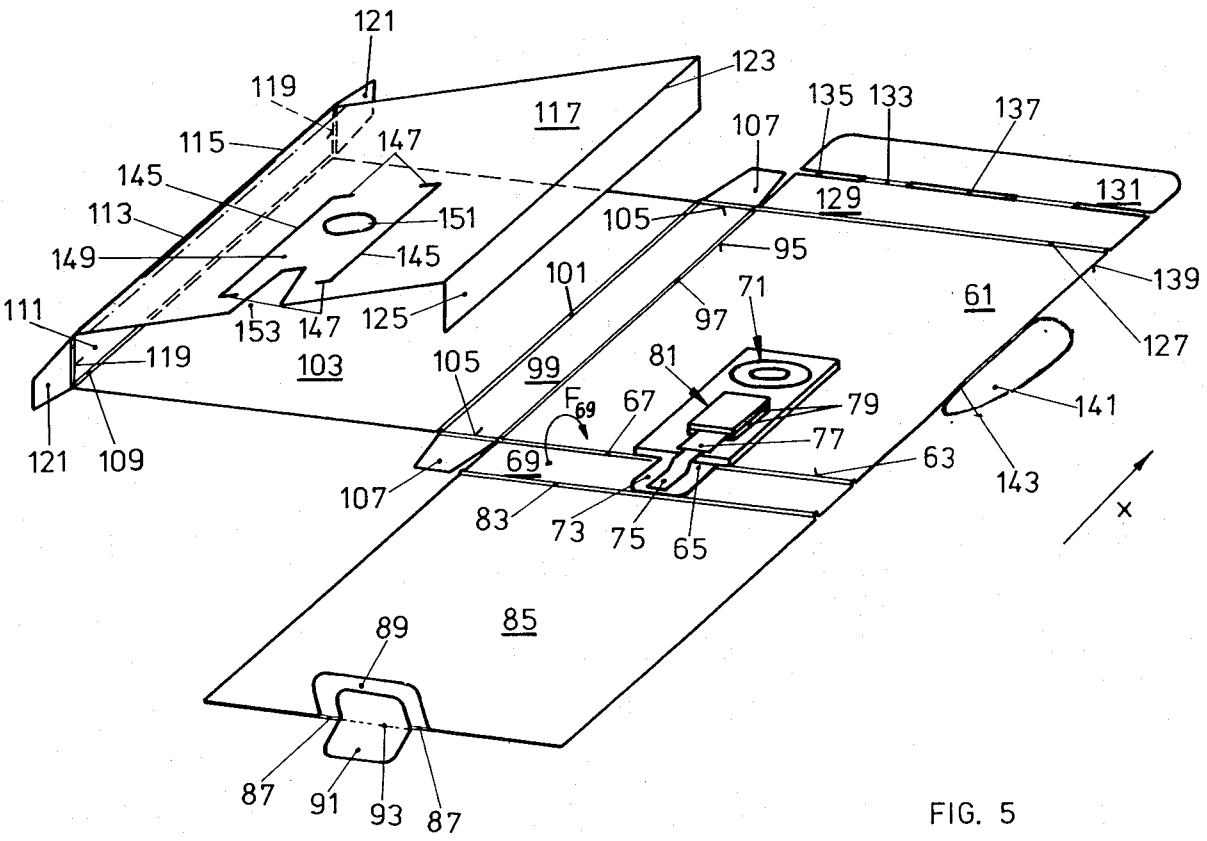
FIG. 5 is a perspective view of a preferred unassembled package for bar chocolate according to the invention, with a generator and a modified package for the use without supplemental means as the generator realized by the omission of certain package parts from the package for generator use.

In FIG. 5 a preferred package for chocolate bars according to the invention, employing the generator shown in FIG. 1, is illustrated in perspective, in disassembled condition. A bottom panel 61 has rectangular form. A fold-line 67 is provided at a first side 63 of the bottom panel 61, on both sides and except of a middle zone 65, whereby the bottom panel 61 is integrally linked to a front panel 69.

The middle zone 65 is cut through. Symmetrically positioned with respect to the middle zone 65 is a generator 71, formed as in FIG. 1, cemented to the bottom panel 61 in such a way that the folding controlled strap 73, designated by 9 in FIG. 1, is cemented to the front panel 69. The fold axis designated in FIG. 1 by A lies exactly on the incision in the middle zone 65. It is thereby assured that the forming up resulting from the fold lines 67 extends only directly up to the strap 73 and the latter lies intimately on the front panel 69 and extends into the generator mounting. As can also be seen in FIG. 1, a hard paper strip 75 is provided on the strap 73 which projects from the strap 73 and which is attached endwise to an insulating strip 77. The insulating strip 77 lies between the metallic contact bands 79 of the generator release switch 81, the details of which according to FIG. 1 are not shown in FIG. 5.

When the front panel 69 is folded down into the illustrated position, the insulation strip 77 is pulled out from between the contact bands 79 and the generator is activated and, conversely, upon folding it up in the direction $F_{69}$, the release switch 81 is again opened.

Opposite the first side 63 a rectangular cover panel is hingedly connected to the front panel 69 by means of a continuous fold line 83. Opposite the fold line 83 there is integrally connected to the cover panel 85, by means of a fold line 87, a tie strap 89 with a cut-out inner tongue 91 which is connected with the cover panel 85 at tear-off perforations 93. A price imprint, for example, is provided on the bottom side of the tongue 91, whereby the price can be removed from the package, as the gift purposes, by merely tearing off the tongue 91 in a simple manner.

Adjacent to the first side of the bottom panel 61 and on a second side 95 of the said bottom panel 61 a further continuous fold line 97 is made, to which a first side panel 99 of the package is once again integrally hinged. Opposite and parallel to the fold line 97 at a further fold line 101 there is hingedly connected, likewise integrally with the above described portions, a rectangular cover panel 103, the dimensions of which correspond at least approximately to those of the bottom panel 61. On both upright edges 105 of the side panels 99 there are fastening tabs 107, again at fold lines. Opposite the fold line 101, the cover panel 103 continues into the second side panel 111 of the container, again at a continuous fold line 109, and that side panel, again integrally and at a fold line 115 broken at a slit portion 113, continues into a cover panel 117 which corresponds at least approximately to the dimensions of the bottom panel 61. On the upright edges 119 of the sides panels 111 there are fastening tabs 121, again at fold lines.

Opposite the fold line 115 the cover panel 117 continues into an inner side panel 125 across a continuous fold line 123.

Opposite the side 63, across a continuous fold line 127, a back wall panel 129 is also hingedly connected to the bottom panel 61 and continues into a closure tab 131. The connection between the back wall panel 129 and the closure tab 131 is realized by means of two fold line bridges 133, wherein the hinge line defined by the fold line bridges 133 are continued in the side zones and in the mid-section by means of incisions 135 and 137, respectively. A kidney-shaped connecting tab 141 is hinged to the fourth side 139 of the bottom panel 61 at a fold line 143. It is aligned in the indicated X-direction with the incision 113.

The described container, formed preferably of cardboard or hard paper as a unitary blank in one blanking operation, with incisions and fold lines produced in the same operation, is formed into the set-up container in the manner indicated in FIG. 5, wherein the side panel 99 is folded up at the fold line 97, then, with the side panel 111 folded up at the fold line 109 and with the cover panel 117 folded in over the fold line 115, the cover panel 103 is folded up around the fold line 101 in such a manner that the cover panel 117 comes to rest over the bottom panel 61 and the inner side panel 125 rests against the inside of the side panel 99. With this the kidney-shaped side tab 141 is laid into the slit 113. The connecting tabs 121 are opposite to the tabs 107 in the X-direction. The tabs 107, 121 that lie opposite one another are bent inward, whereupon the back wall panel 129 is bent up around the fold line 127 and the closure tab 131 is inserted under the cover panel 103. Thus, a container is created that is particularly suitable for the reception of chocolate bars and which can now be locked shut with the help of the cover panel 85, this last being set up after folding in of the remaining tabs 107 and 121 and then locking the package shut by the insertion of the connectin band 89 into the center incision 37. As is seen, the tongue 91, provided e.g. with a price imprint, now protrudes from the package and can be removed as desired. The cover panel 117 along with the bottom panel 61 forms a double bottom for the generator 71. Two slits 145, again in the X-direction and parallel to one another, are provided in the cover panel 117, aligned on the carrier rectangle for the generator 71, and they preferably have end incisions 147 in order to prevent the tearing of the slits 145.

In the cover band 149 formed between the slits 145 a trapezoidal cutout 153 is made which assures clearance for free actuation of the actuating band 73, strips 75 and 77 relative to control switch 81 of the generator. The container or, better, the carton, is assembled without any glue-points, and in this the kidney-shaped connecting tab 141 assures good stability thanks to its barb-like function in relation to the incision 113.

If such a carton is to be used without provision of a generator as a conventional packaging carton, the cover panel 117 is omitted and only a small edge is left connected to the fold line 115, as indicated by the dotted line, so that the slit location 113 will still be defined. Also, a simplified carton of this type has essential advantages in its manufacture and assembly, with respect to manufacture costs for example. It is obvious that the described carton set-ups can be suitably imprinted on their undersides before their assembly.

It is also obvious that the back wall panel 129 could just as well be provided on the cover panel 85, and in fact where the connecting band 89 is drawn in in FIG. 5, whereby the latter would then be connected to the following the back wall panel 129. Also, the tear-off tab 91 would then be kept.

Figure 6:
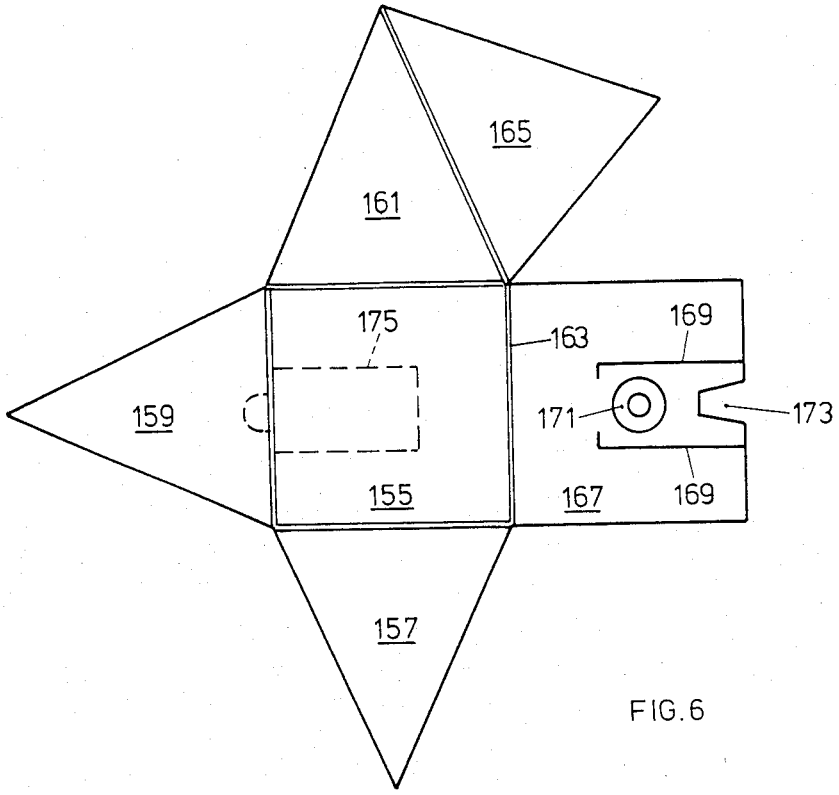
FIG. 6 is the blank for a pyramid-shaped package according to the invention, with or without a generator to be provided.
Figure 7:
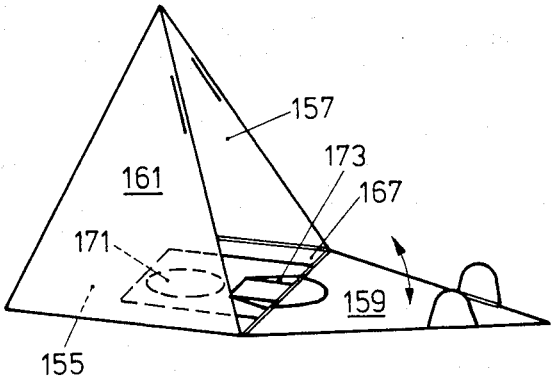
FIG. 7 is a perspective view of the package according to FIG. 6 with the generator present, in opened condition.

In FIG. 6 the blank for a pyramid-shaped container is illustrated, likewise for the installation of a generator such as is illustrated in FIG. 1, but also having advantages as a conventional pyramid carton without the provision of a generator—as was already shown in the embodiment according to FIG. 5—and also as far as manufacturing costs are concerned. It comprises a square base panel 155. Triangular panels 157, 159 and 161 are hinged to three sides of the panel 155 at hinge lines. A fourth triangular panel 165 is hinged to the one side of the triangular side panel 161 at a fold line, adjacent to the fourth side 163 of the square. With the means described up to this point, with suitable tabs, a pyramid package is realized of unitary blank that can be put together without glue-points. If a covering is to be provided for the provision of a generator such as is illustrated in FIG. 1, a cover panel 167 is provided on the fourth square side, with slits 169, a resonance hole 171 and a cutout 173 analoguous to the embodiment according to FIG. 5. The cover panel 167 is turned in around the fold line provided on the side 163, over the generator 175 indicated by dotted lines, and the generator's activating strap is connected with the triangular side panel 159 in the manner and by the means described in FIG. 5. The triangular side panel 159 then operates as a cover that can be opened, as illustrated in FIG. 7.

With the described package according to the invention in all its variations a novel, surprising packaging concept is created with which the attractiveness of small gift products can be drastically increased with very slight additional cost.

I claim:

1. A package for a product comprising:

a container having a space therein for receiving said product and comprising interconnected wall portions and including a cover wall portion movable between closed and open positions and a mounting wall portion at least in part formed of resiliently yieldable material;

a substantially flat device having opposite sides and including a battery powered signal generator means for generating at least one of an accoustical signal or an optical signal and switch means for actuating said signal generator means;

means for connecting said cover wall portion and said switch means so that said signal generator means generates a signal when said cover wall portion is moved to said open position;

and means for mounting said device on said mounting wall portion and comprising two parts of said mounting wall portion which are interconnected with each other and which are resiliently and elastically biased toward each other and engage at least portions of said opposite sides of said device.

2. The package according to claim 1 wherein said two parts of said mounting wall portion comprise two layers and wherein said device is located therebetween.

3. The package according to claim 1 wherein said mounting wall portion comprises at least one layer having at least two substantially parallel slits formed therein, and wherein one of said two parts is between said two slits and the other of said two parts is outside of said two slits.

4. The package according to claim 1 wherein said mounting wall portion comprises two layers made of one piece of said material.

5. The package according to claim 1 wherein said container is made of a unitary blank and is assemblable by folding or bending.

6. The package according to claim 5 wherein said blank comprises at least one connecting tab or slit junction for receiving said tab to effect is assemblage.

7. The package according to claim 1 wherein said container comprises:

a substantially rectangular bottom portion;

a substantially rectangular first side wall portion;

and said cover wall portion;

and wherein one side of said cover wall portion is hinged to a first side of said first side wall portion, and wherein a second side of said first side wall portion which is opposite said first side of said first side wall portion is hinged to one side of said bottom portion.

8. The package according to claim 7 wherein said container comprises:

a substantially rectangular second side wall portion;

and a second cover portion;

and wherein one side of said second cover portion is hinged to a first side of said second side wall portion, and wherein a second side of said second side wall portion which is opposite said first side of said second side wall portion is hinged to a second side of said bottom portion.

9. The package according to claim 8 wherein said second side of said bottom portion abutts said one side of said bottom portion.

10. The package according to claim 7 wherein said container further comprises:

a second substantially rectangular side wall portion;

and a second bottom portion;

and wherein one side of said second bottom portion is hinged to a first side of said second side wall portion, and wherein a second side of said second side wall portion which is opposite said first side of said second side wall portion is hinged to a second side of said cover wall portion.

11. The package according to claim 10 wherein said second side of said cover wall portion is opposite said one side of said cover portion.

12. The package according to claim 10 wherein said device is disposed between said first and second bottom portions.

13. The package according to claim 12 wherein one of said first and second bottom portions comprises two substantially parallel slits, and wherein a part of said portion therebetween overlies said device.

14. The package according to claim 12 wherein said container further comprises a third side wall portion, and wherein said means for connecting said switch means comprises a pull-wiper connected to said third side wall portion.

15. The package according to claim 1 wherein said container is of a one-piece blank of said material.

16. The package according to claim 1 wherein at least one of said wall portions comprises a removable tear-off tab with indicia thereon.

17. The package according to claim 1 wherein said means for connecting said switch means and said cover wall portion comprises a pull-wiper connected to said cover wall portion.

18. The package according to claim 1 wherein said container comprises:

a substantially rectangular bottom portion;

three triangular side wall portions;

and a triangular side wall portion forming said cover wall portion;

wherein said three triangular side wall portions are hinged to respective sides of said bottom portion, and wherein said opening side wall portion forming said cover wall portion is hinged to one side of one of said three triangular side wall portions which abutts a remaining fourth side of said bottom portion.

19. The package according to claim 18 wherein said container comprises a second bottom portion which is hinged to said remaining fourth side of said one bottom portion.

20. The package according to claim 19 wherein said device is disposed between said two bottom portions.

21. The package according to claim 20 wherein one of said bottom portions comprises at least two substantially parallel slits, and wherein a part of said one bottom between said slits overlies a portion of said device.

22. The package according to claim 20 wherein said means for connecting said switch means comprises a pull-release wiper connected to said triangular opening side wall portion forming said cover wall portion.

23. The package according to claim 1 wherein said container material is formed of cardboard or hard paper.

24. The package according to claim 1 wherein said generator means comprises a tone sequence generator.

25. The package according to claim 1 wherein said generator means comprises a light-emitting generator.

26. The package according to claim 1 wherein said generator means comprises a melody generator and a light-emitting generator.

* * * * *